US005979051A

United States Patent [19]

Kato et al.

[11] Patent Number: 5,979,051

[45] Date of Patent: Nov. 9, 1999

[54] HEAT EXCHANGER AND METHOD OF PRODUCING THE SAME

[75] Inventors: Soichi Kato; Muneo Sakurada; Shin Kurihara; Sadao Haiya; Takashi Sugita; Shoji Akiyama; Takahumi Umehara, all of Saitama, Japan

[73] Assignee: Zexel Corporation, Tokyo, Japan

[21] Appl. No.: 09/007,829

[22] Filed: Jan. 15, 1998

[30] Foreign Application Priority Data

Jan. 20, 1997 [JP] Japan ..... 9-007920
Oct. 15, 1997 [JP] Japan ..... 9-282302

[51] Int. Cl.[6] ..... F28F 1/00

[52] U.S. Cl. ..... 29/890.049; 165/174; 165/176; 165/179; 165/183; 29/890.05

[58] Field of Search ..... 165/173, 177, 165/174, 176, 181, 183, 179; 29/890.049, 890.05

[56] References Cited

U.S. PATENT DOCUMENTS 2,757,628 8/1956 Johnston ..... 165/177
4,043,015 8/1977 Hickman et al. ..... 29/157.4
4,309,987 1/1982 Higgins, Jr. ..... 165/159
4,688,311 8/1987 Saperstein et al. ..... 29/157.3
4,971,240 11/1990 Wallis ..... 228/146
5,185,925 2/1993 Ryan et al. ..... 29/890.049
5,186,250 2/1993 Ouchi et al. ..... 165/177
5,251,692 10/1993 Haussmann ..... 165/152
5,409,057 4/1995 Zifferer ..... 165/156
5,441,106 8/1995 Yukitake ..... 165/177
5,560,424 10/1996 Ogawa ..... 165/183
5,579,837 12/1996 Yu et al. ..... 165/183
5,689,881 11/1997 Kato ..... 165/177
5,697,433 12/1997 Kato ..... 165/177

*Primary Examiner*—Ira S. Lazarus
*Assistant Examiner*—Terrell McKinnon
*Attorney, Agent, or Firm*—Kanesaka & Takeuchi

[57] ABSTRACT

A heat exchanger that a tube member 2' has beads 21 protruded from the face of one plate toward the other plate, tube member 2' is held by block members 31, 31, a forming jig 40 is inserted between medium passages 24, 24 formed by the beads 21 to hold to press the beads 21 at an end 2*a* of the tube member 2' to mutually adhere the faces of the beads 21 on the outer face of the tube member 2', and recesses formed by the mutually contacted faces of the beads 21, 21 have a cross-sectional area of about 0.2 $mm^2$ or below. And, a region where the recesses have a cross-sectional area of about 0.2 $mm^2$ or below is within 10 mm outside header pipes 3, 4.

6 Claims, 12 Drawing Sheets

HEAT EXCHANGER AND METHOD OF PRODUCING THE SAME

BACKGROUND OF THE INVENTION

1. Technical Field of the Invention

The invention relates to a heat exchanger, comprising tubes for a heat exchanger, each tube formed by bending a single plate or stacking two plates, and to communicate with header pipes, and a method of producing the same.

2. Prior Art

A conventionally known heat exchanger comprises a plurality of tubes for making heat exchange of a medium, and header pipes for distributing and collecting the medium, and wherein the tubes are communicatively connected to header pipes.

As shown in FIG. 13, a tube used for such a type of heat exchanger includes a tube 60 which is known being formed by an extrusion molding. This tube 60 is formed into a flat tube by the extrusion molding of an aluminum or aluminum alloy material which is excellent in forming property, and integrally forming partition walls 61 at predetermined intervals in the breadth direction of the tube, to divide a single internal passage 62 into a plurality of passages 62*a*.

As shown in FIG. 14, it is known that an inner fin type tube 70 is formed by inserting inner fins 71, which are made of another member and have a serpentine cross section, into the tube 70 to divide an inner passage 72 of the tube into a plurality of passages 72*a* by the inner fins 71.

It is also known to form a metallic plate of aluminum light alloy or the like into a predetermined tube (hereinafter called the tube member) and to braze the tube member as required. This plate is formed by rolling or pressing.

The plate used for such a tube member is generally a brazing sheet having a brazing material claded on its entire surface. Brazing of required parts of the tube member and brazing of other required parts of the heat exchanger are performed by heating an assembled body which was formed into one body by assembling the tube members, header pipes and other parts by means of a jig and the like.

As shown in FIG. 12, for example, a tube member 50' is formed into a predetermined tube by forming beads 51, 51 at appropriate intervals on a strip plate, forming bonding sections 52, 52 at the edges of the plate in its breadth direction, and bending the plate along a bending part 53 at the center in the breadth direction. A plurality of medium passages 54, 54 divided by the beads 51, 51 are formed in the tube. And, the tops of the beads 51, 51 and the opposed inner parts of the tube and the bonding sections 52, 52 are bonded by brazing. The beads can be formed into various shapes such as circular or ellipse depending on uses.

As described above, where a plurality of passages are formed in the tube by the partition walls, inner fins or beads, the inner pressure resistance of the tube itself can be improved, and an appropriate turbulence can be produced in the flow of a heat exchange medium to improve a heat exchange efficiency.

Since the tube 60 formed by the extrusion molding is made of the aluminum or aluminum alloy suitable for the extrusion forming as described above, the fin is often made of a fin material having a brazing material claded in combining the tube and the fin. Where the fin material having the brazing material claded is used to form the fin, a die for forming the fin is abraded heavily, maintenance costs increase, fin material costs increase, and costs in general are increased.

And, the inner fin type tube 70 is needed be produced by separately producing the inner fin 71 and inserting it into the tube 70, resulting in increasing material, fabricating and assembling costs.

On the other hand, the tube member 50' having the beads 51 formed is considered having a lot of advantages in view of production processes, production costs and the like. In this case, the ends of the tube member 50' are inserted into and brazed with the tube holes of the header pipes, and it is required that the joint sections are brazed well to secure the fluid tightness of a medium.

But, since the recesses of the beads 51 at the ends of the tube member 50' form a relatively large gap between the end of the tube member 50' and the tube hole, the brazing becomes defective conventionally, and a ratio of quality products is lowered.

Therefore, the invention described in Japanese Patent Laid-Open Publication No. Hei 4-86489 discloses a tube, which is formed by bending a plate to adhere tightly along the longitudinal direction of the tube to form a bent double-walled projection, so that the leading end face of the projection is contacted with the opposed plate face. Since this tube is formed by bending a plate to adhere tightly to form the double-walled projection, the upper and lower faces of the tube become substantially flat, and the tube can be assembled to the header pipe without forming a gap, so that a problem of brazing property can be remedied.

But, it is hard to uniformly form the double-walled projection, which was formed by bending to tightly adhere the plate, along the longitudinal direction of the tube, and the production process becomes complicated. And, since the top of the double-walled projection formed on the tube is in contact with the plate face, the contact area is reduced, the brazing property is degraded, and the pressure resistance is lowered.

On the other hand, since the beads can be formed uniformly and quickly by rolling, pressing or die forming before or simultaneous with forming the tube, the production process is simple and easy. And, since the bead tops can be bonded to the plate face, the brazing area is increased to improve the brazing property, and the pressure resistance is improved.

SUMMARY OF THE INVENTION

Accordingly, it is an object of the present invention to provide a heat exchanger which can improve the brazing property between the tube member and the tube holes of the header pipe by forming the upper and lower faces at the ends of the tube member having beads substantially flat by means of a jig, and a method of producing it.

The invention relates to a heat exchanger comprising a plurality of tube members formed by bending a single plate or stacking two plates, and the ends of the tube members inserted into tube holes of header pipes to communicate the tubes with the header pipes, characterized in that the tube members are provided with beads formed to protrude from the face of one plate toward the other plate, the tube members have the bead faces bonded mutually on the outer faces of the tube members at their ends which are inserted into the tube holes of the header pipes so that the upper and lower faces of the ends of tube members are substantially flat.

Thus, since the upper and lower faces at the end of the tube member are formed substantially flat, the substantially flat face of the tube comes in contact with the end of the tube insertion hole, the tube can be assembled to the header pipe without forming a large gap between the tube insertion hole and the tube, and the brazing property can be improved. Therefore, a ratio of non-quality products in the production is reduced, and the product reliability can be improved.

And, the tube's strength in the header pipe can be secured by the beads with the inner faces mutually contacted as described above.

The invention relates to the heat exchanger, wherein a recess formed by mutually bonding the bead faces on the outer face of the tube member have a cross-sectional area of about 0.2 $mm^2$ or below.

When the recesses of the beads at the end of the tube member have a cross-sectional area of about 0.2 $mm^2$ or below, the end of the tube member and the tube hole of the header pipe can be brazed well, and a ratio of quality products can be improved.

The recesses of the beads at the end of the tube member have formed a gap between the tube hole of the header pipe, causing a failure in brazing. But, the present invention can fill the gap with a brazing material flowing while brazing because such a recess has a cross-sectional area of about 0.2 $mm^2$ or below and can improve the brazing property.

The invention relates to the heat exchanger, wherein a region, where the recess has a cross-sectional area of about 0.2 $mm^2$ or below, is disposed within 10 mm outside the header pipe.

When a region, that the cross-sectional area of the recess of the bead is about 0.2 $mm^2$ or below, is formed within 10 mm outside the header pipe, an inserted degree of the tube into the tube hole can have a maximum clearance of 10 mm, and as a result, the brazing reliability between the end of the tube member and the tube hole of the header pipe can be improved.

Even if the inserted degree of the end of the tube member is different from the one initially determined due to deviation of the sizes of the tube member, the end of the tube member and the tube hole of the header pipe can be brazed well.

The invention relates to the heat exchanger, wherein the bead at the end of the tube member has a wall thickness smaller than that of the plate.

At the end of the tube member, the beads have a wall thickness smaller than that of the plate, and, therefore, the end of the tube member can be fabricated readily.

The invention relates to the heat exchanger, wherein the end of the tube member is formed by compressing in the breadth direction and has a cross-sectional shape corresponding to the tube hole.

Since the end of the tube member is formed by compressing, a predetermined size can be obtained accurately, so that a situation that the end of the tube member cannot be inserted into the tube hole of the header pipe can be prevented.

And, the end of the tube member has a cross-sectional shape corresponding to the tube hole, so that the insertion of the tube member into the tube hole can be secured properly.

The invention relates to the heat exchanger, wherein a tapered portion is formed from the outer to inner sides along an axial direction of the tube member toward the leading end of the end of the tube member.

Thus, since the heat exchanger of this claim forms the taper from outer to inner sides along the axial direction of the tube member toward the leading end of the end of the tube member, the end of the tube member can be inserted into the tube hole of the header pipe with ease, and the efficiency of assembling the tube member and the header pipe can be improved.

The invention relates to a method of producing a heat exchanger comprising a plurality of tube members formed by bending a single plate or stacking two plates, and the ends of the tube members inserted into tube holes of header pipes to communicate the tubes with the header pipes, comprising the steps of: forming a plurality of beads to protrude from the face of one plate toward the other plate so that a plurality of passages, through which a heat exchange medium flows, are formed inside the tube members by the beads, inserting a jig between the passages from the end of the tube member to hold side walls of the beads at the end edge of the tube member and press them together, thereby the bead faces at the outer face of the tube member are brought in pressure contact, and forming the upper and lower faces of the end of the tube member substantially flat, and inserting the tube members, which have the inner faces of the beads in pressure contact with each other to make the upper and lower faces of the ends of the tube members substantially flat, into the header pipes to assemble them together, and brazing them integrally.

Thus, the jig is inserted into the passages of the tube member from the end of the tube member to press the bead side walls, so that only the upper and lower faces of the tube end can be formed substantially flat. Using the tube having the beads formed uniformly and quickly, a heat exchanger having good brazing property can be produced. According to the method of the present invention, it is not necessary to form a double-wall projection along the longitudinal direction of the tube to make the upper and lower faces of the tube substantially flat like the prior art, and the production can be simplified. And, since the tops of the beads are contacted to the flat face of the opposed plate, the contact areas are increased to provide good brazing property, and the pressure resistance of the tube is improved.

FIG, 13 is a sectional view of the tube and the fin according to a conventional embodiment.

Figure 14:
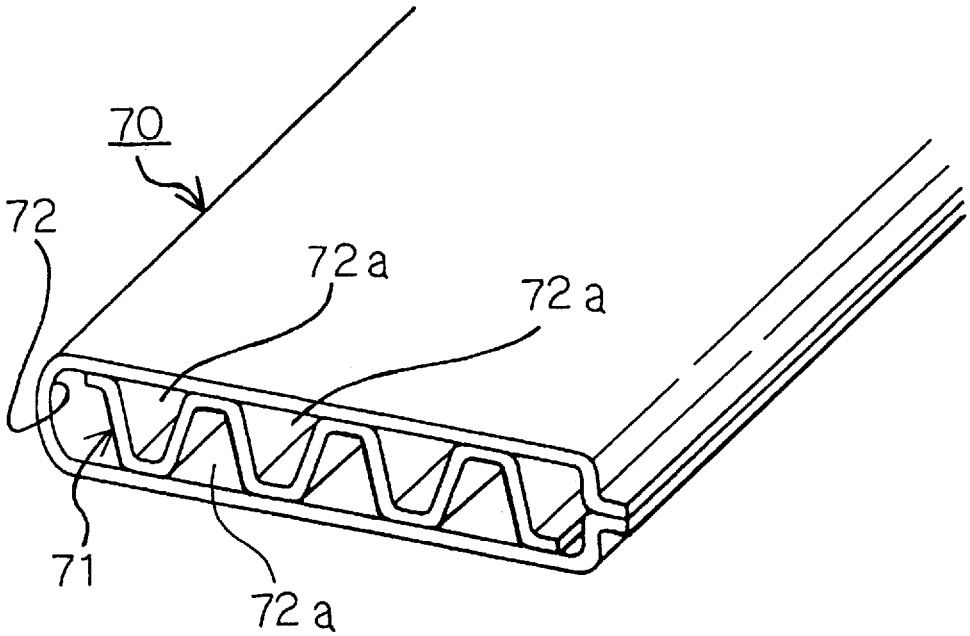

FIG. 14 is a perspective view showing the tube member according a conventional embodiment.

DESCRIPTION OF THE PREFERRED EMBODIMENT

Embodiments of the invention will be described with reference to the drawings.

Figure 1:
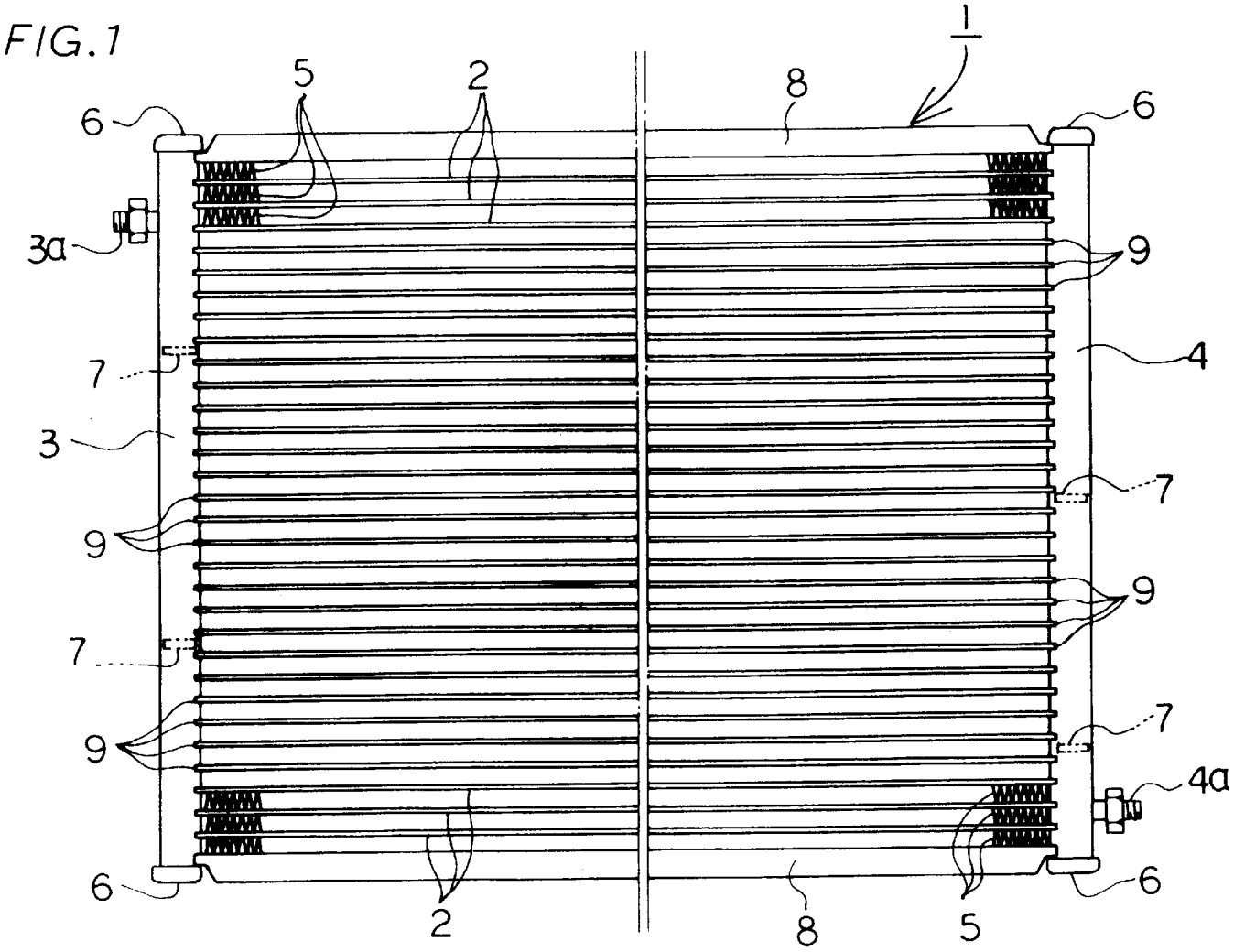
FIG. 1 is a front view showing a heat exchanger according to an embodiment of the invention.

As shown in FIG. 1, a heat exchanger 1 of the invention has a plurality of tubes 2, 2, which are stacked with fins 5, 5 intervened between them, connected to communicate with header pipes 3, 4 which are disposed on both ends of the tubes 2, 2.

The respective header pipes 3, 4 have upper and lower end openings closed by blind caps 6, 6 and their interior divided by partition plates 7, 7 disposed at given locations. Besides, they are circular tubes provided with an inlet joint 3*a* to receive a medium or an outlet joint 4*a* to discharge the medium outside.

And, tube holes 9, 9 are formed in the longitudinal direction of the header pipes 3, 4 at predetermined intervals. The tubes 2, 2 have their ends connected to the tube holes 9, 9.

And, side plates 8, 8 are disposed at the top and bottom of the layer of the tubes 2, 2. The side plate 8 has its ends fixed to the header pipes 3, 4 to reinforce the structural strength of the heat exchanger.

In this structure, the medium taken through the inlet joint 3*a* is meandered a plurality of times to flow between the header pipes 3, 4 in a unit of a given group of tubes, passed through the tubes 2 while heat-exchanging, and discharged from the outlet joint 4*a*. And, the heat exchange by the medium is promoted with the heat radiation effect by the fins 5 intervened between the tubes 2 and the side plates 8As As shown in FIG. 1, the tube 2 is formed by inserting the ends of a tube member 21, which was formed by forming a metallic plate into a tube, into the tube hole 9 of the header pipe 3 or header pipe 4, and brazing the connected section and the required parts of the tube member 2'.

Figure 2:
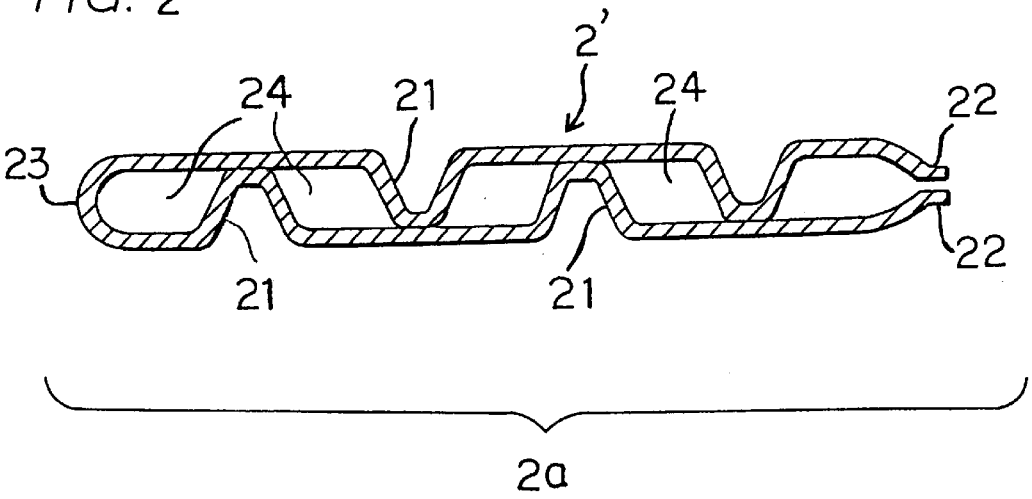
FIG. 2 is a diagram showing the end face of a tube member according to an embodiment of the invention.

As shown in FIG. 2, the tube member 2' of this embodiment is formed by forming a plurality of beads 21, 21 in the longitudinal direction of a strip plate, forming bonding sections 22, 22 on both ends of the strip plate in its breadth direction, and bending the plate along a bending part 23 at the center in the breadth direction. These beads 21, 21 are formed by bending the plate to form recesses. And, the plate is a brazing sheet made of an aluminum light alloy having a brazing material claded on its entire face.

The beads 21 and the bonding sections 22, 22 are formed to have a predetermined height corresponding to the thickness of the tube 2, and the bending part 23 is bent at a given curvature corresponding to the thickness of the tube. Specifically, the bonding sections 22, 22 are mutually contacted by bending the plate along the bending part 23, so that a plurality of medium passages 24, 24 which are divided by the beads 21, 21 are formed in the tube member 2'.

Roll forming is performed to form the beads 21, 21, to form the bonding sections 22, 22 and to bend the bending part 23. Specifically, it is performed by passing the strip plate between a plurality of rolls disposed appropriately.

Figure 3:
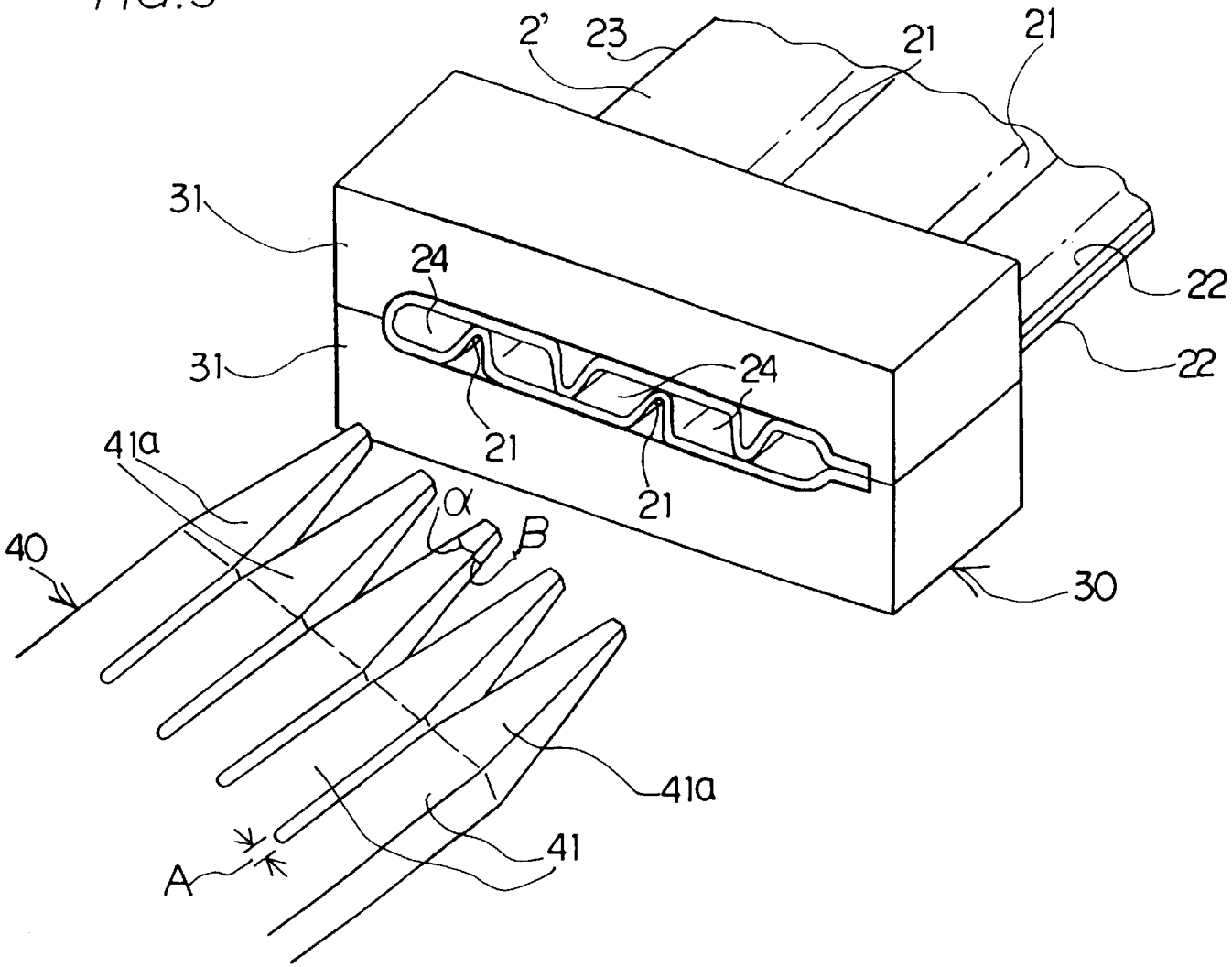
FIG. 3 is an appearance view showing a die and a forming jig used to form the end of the tube member according to an embodiment of the invention.

In this embodiment, the tube member 2' is inserted into a die 30 having an inner die with a predetermined shape and has its end 2*a* compressed as shown in FIG. 3.

This die is made of a material having the mechanical strength higher than that of the tube member 2' and formed of a plurality of block members 31, 31 with the inner die divided. The inner die of the block members 31, 31 has a cross section which is formed into a simple oblong shape having a parallel section with the thickness and width of the tube member 2'. And, this cross section is formed to continue longer than at least the flat section formed on the tube member 2'. Therefore, where a forming jig 40 to be described afterward is inserted, the outer periphery in the neighborhood of the end of the tube 2 is formed into a simple oblong shape having a parallel section.

And, the block members 31, 31 are supported by a holding mechanism (not shown). By this supporting mechanism, the die is opened immediately after compressing the end 2*a* of the tube member 2', so that the tube member 2' can be separated from the die readily.

In compressing, the forming jig 40 shown in the drawing is inserted into medium passages 24, 24 from the end of the tube member 2' to contact the faces of the beads 21, 21 at the end 2*a* of the tube member 2*a*.

Specifically, this forming jig 40 is made of a material having the mechanical strength higher than that of the tube member 2' like the block members 31, 31 and has a thickness substantially equal to a length between the opposed inner faces of the tube 2'. And, its leading end is formed to have a plurality of comb-teeth type projections 41, 41 with a width substantially equal to a width of the passage 24 in a breadth direction of the forming jig 40 such that it can be inserted between the passages 24, 24 for the medium. The base of these projections 41 is formed to have a cross section in a substantially rectangular shape. And, a gap A, which is smaller than the thickness of the overlaid tube members 2', is formed between the adjacent projections 41, 41. For example, where a thickness of the tube member 2' at its end is 0.45 mm, a thickness of the tube member 21 with the faces having the beads 21, 21 overlaid mutually becomes 0.9 mm, and in this case, the gap A is determined about 0.5 mm. And, the projections 41, 41 have a length equal to that of each gap A provided between the projections 41, 41. This length is determined longer than that of the flat section formed on the end of the tube member 2'.

Leading ends 41*a*, 41*a* of the projections 41, 41 are divided and formed into a tapered shape having a given taper angle $\alpha$ in the breadth direction, and also tapered to have a given taper angle $\beta$ in the thickness direction. And, the leading ends 41*a*, 41*a* of the projections are also determined to have the same length.

Now, a process of forming the end of the tube member 2' by the die 30, which has the block members 31, 31 and the forming jig 40, will be described.

First, the end of the tube 2' is firmly held between the block members 31, 31. The leading ends 41*a* of the forming jig 40 are inserted into the end of the tube member 2*a*. The leading ends 41*a* are in the medium passages 24, 24 and further inserted to press the beads 21, 21 as the forming jig 40 is pushed, so that the side walls of the beads 21, 21 are mutually adhered tightly. Specifically, the side walls of the beads 21 are gradually pressed with the insertion of the tapered leading ends 41*a*, and finally the side walls of the beads 21, 21 at the end of the tube member 2' are held between the gaps A of the forming jig 40.

Figure 4:
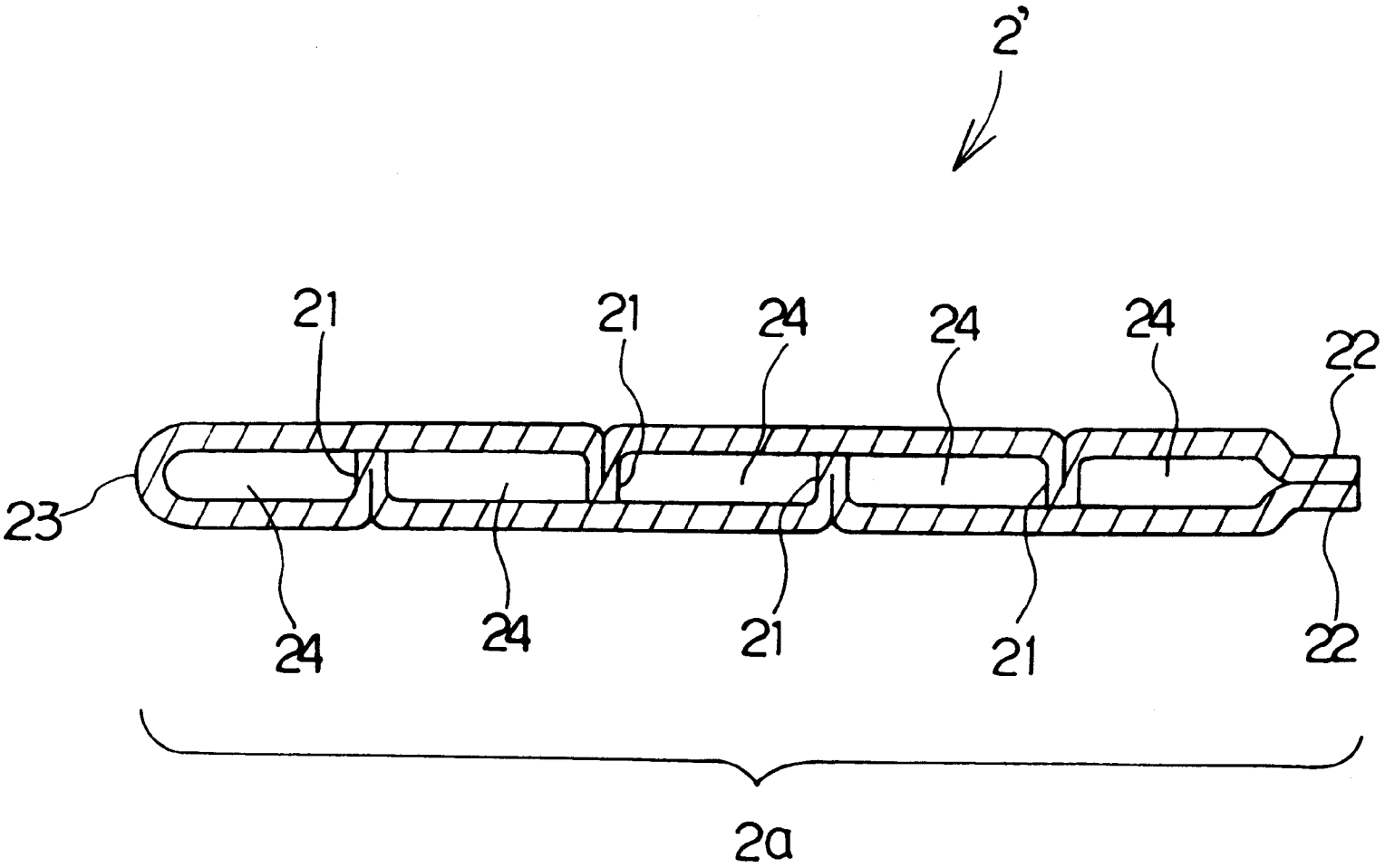
FIG. 4 is a diagram showing the end face of a tube material according to an embodiment of the invention.

As shown in FIG. 4, therefore, the side walls of the beads 21 are mutually adhered tightly, the end of the bead 21 at the end of the tube member 2 becomes a doubled-walled projection, and the top and bottom faces of the tube member 2' become substantially flat.

In this case, since the protruded leading end 41*a* of the forming jig 40 has tapered shapes $\alpha$, $\beta$ in breadth and thickness directions, the forming jig 40 can be inserted smoothly into the medium passages 24, 24 of the tube member 2' without crushing the end of the tube member 2' or deforming the end of the tube member 2' into a peculiar shape.

Figure 5:
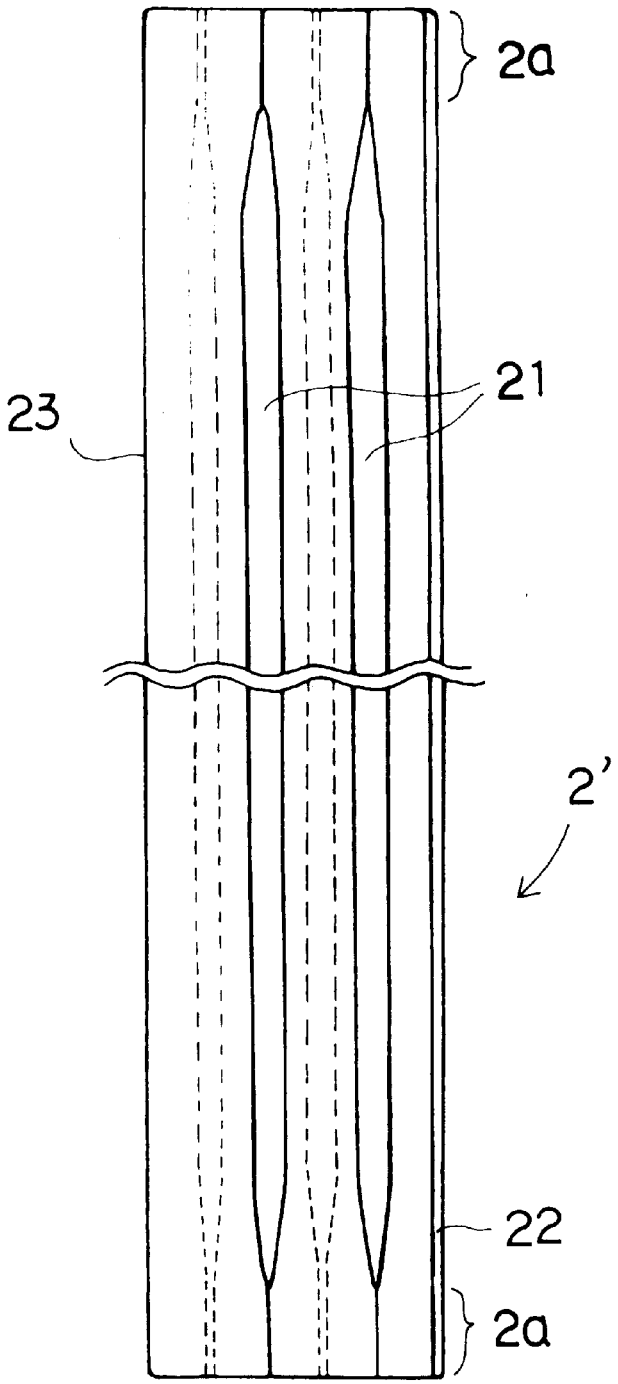
FIG. 5 is a plan view of a tube material according to an embodiment of the invention.

FIG. 5 is a plan view of the tube member 2' in a state that the ends 2*a* are compressed. In FIG. 5, the portions indicated by dotted lines show that the beads 24 are contacted with the flat face of the tube member 2'.

And, if a thickness t of the beads of the tube member 2' is, for example 0.45 mm, the side walls of the beads 21, which are adhered tightly into a double wall, have a thickness of 0.9 mm. But, since the gap A of the forming jig 40 is determined to be a size smaller, e.g., 0.5 mm, than the thickness of the double wall, the beads 21, 21 at the end 2*a* are held between the gaps A, an excess thickness is pushed toward the surface of the tube member 2', and since the outer periphery of the tube member 2' is held by the block members 31, 31, the surface of the tube member 2' can be made substantially flat as will be described afterward.

Figure 6:
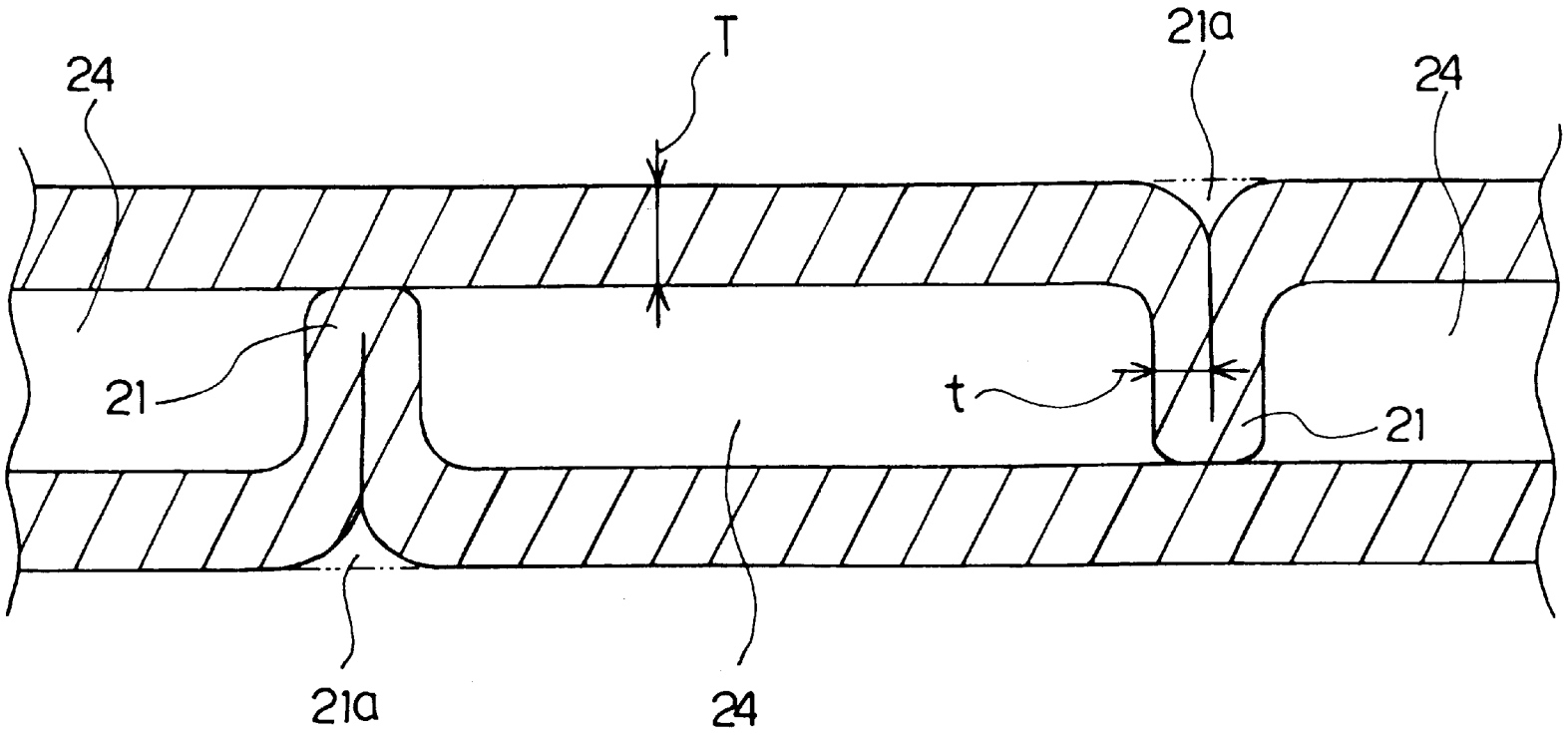
FIG. 6 is a diagram showing a part of the end face of a tube member according to an embodiment of the invention.

FIG. 6 is an enlarged diagram showing the essential portion of the end 2*a* of the tube member 2'. As shown in FIG. 6 and FIG. 4, the beads 21, 21 at the end 2*a* of the tube member 2' have the bead faces contacted mutually, and its recess 21*a* has a cross-sectional area of 0.2 $mm^2$ or below.

Namely, as a result of adhering the bead faces of the beads 21 as described above, the cross-sectional area of the recess 21*a* of the bead 21 is contracted to 0.2 $mm^2$ or below.

As indicated by arrows in FIG. 6, a thickness t of the bead 21 is smaller than a thickness T of the plate. This is because the part of the plate to have the bead 21 formed is rolled under pressure by the rolls during roll forming.

The tube member 2' thus formed is assembled with its ends 2*a* inserted into the tube holes 9, 9 of the header pipes 3, 4 and conveyed into the oven to be heated for brazing. Namely, the ends 2*a* of the tube member 2' are brazed with the tube holes 9, and the tops of the beads 21 are brazed with the opposed inner face of the tube member, and the bonding sections 22, 22 are mutually brazed.

Figure 7:
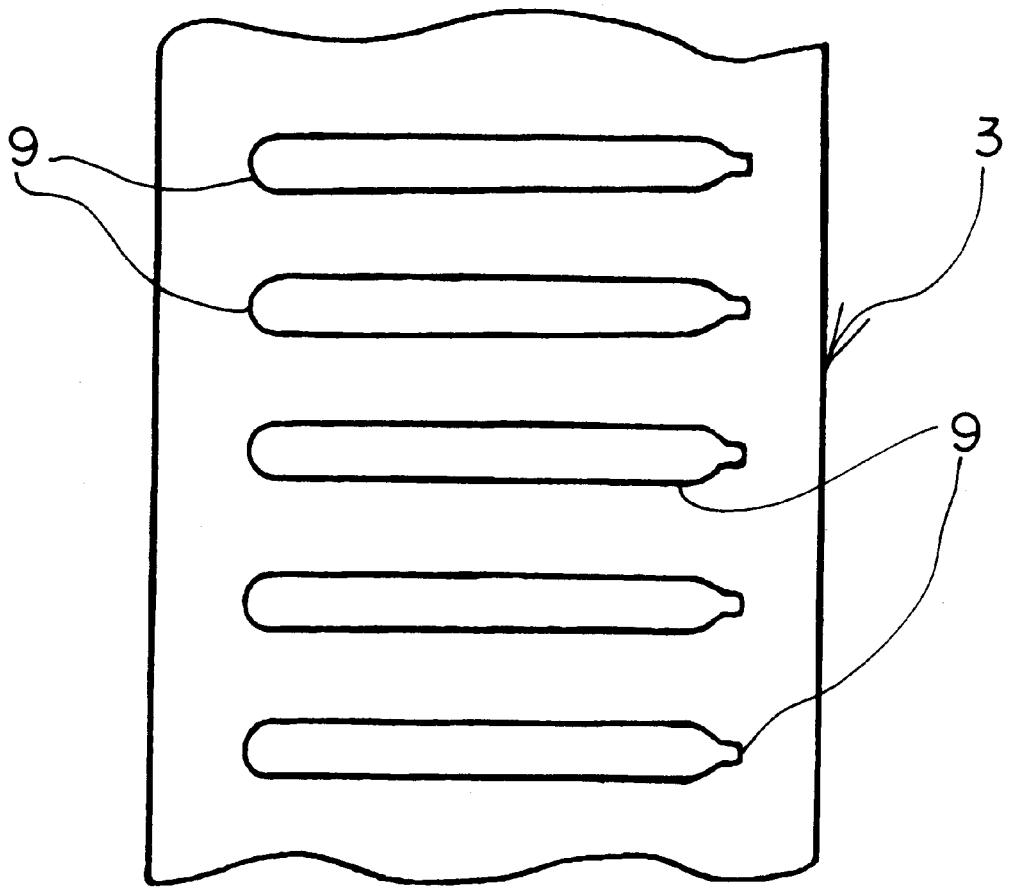
FIG. 7 is a front view showing a part of the header pipe according to an embodiment of the invention.

FIG. 7 is a front view showing the tube holes 9, 9 of the header pipes 3, 4. As shown in the drawing, the tube holes 9 generally have a cross section of the end 2*a* of the tube member 2*a*. Especially, a gap is formed between the tube hole 9 and the end 2*a* of the tube member 2' by the recess 21*a* of the bead 21, but since the cross-sectional area of the recess 21*a* of the bead 21 is 0.2 $mm^2$ or below, the gap is readily filled with the brazing material which is flown while brazing.

As described above, in the heat exchanger of this embodiment, since the cross-sectional area of the recess of the bead at the end of the tube member is 0.2 $nm^2$ or below, the end of the tube member can be brazed well with the tube hole of the header pipe, and a ratio of quality products can be improved.

Specifically, the recess of the bead at the end of the tube member forms a gap with the tube hole of the header pipe and causes a defective in brazing. But, the cross-sectional area is about 0.2 $mm^2$ or below in this embodiment and the gap can be filled with the brazing material which is flown while brazing, so that the brazing property can be improved.

And, the cross-sectional area of the recess of the bead can be determined to about 0.2 $nm^2$ or below by contacting the bead faces mutually on the outer face of the tube member.

And, the strength of the tube in the header pipe can be secured by the beads with the inner faces mutually contacted.

Even when an inserted degree of the end of the tube member is different from the initial determination due to deviation of the sizes of the tube members, the end of the tube member and the tube hole of the header pipe can be well brazed if a cross-sectional area of the recess of the bead is in a range of about 0.2 $mm^2$ or below.

In the heat exchanger of the embodiment, the bead has a wall thickness smaller than that of the plate at the end of the tube member, so that the end of the tube member can be fabricated with ease.

And, the end of this tube member has a cross-sectional shape corresponding to the tube hole, so that a predetermined size can be obtained accurately, and a situation that the end of the tube member cannot be inserted into the tube hole of the header pipe can be prevented. In this embodiment, the leading ends of the beads are contacted to the other plate face, but the leading ends of the beads protruded from both plates may be contacted mutually.

FIG. 8 through FIG. 11 show other embodiments of the tube member 2'.

Figure 8:
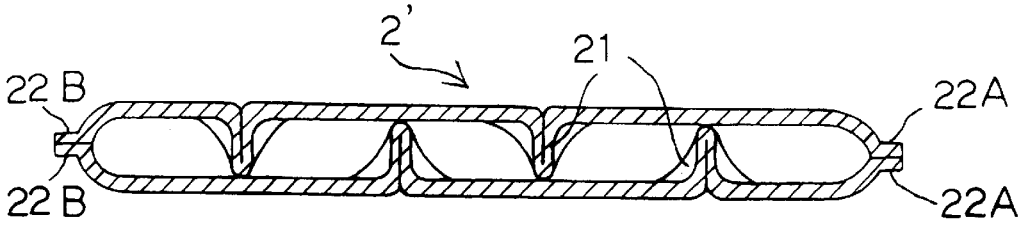
FIG. 8 is a sectional view of the tube member end according to another embodiment of the invention.

The tube shown in FIG. 8 has the forming of beads described above applied to a two-split type tube. As shown in FIG. 8, the tube member 2' of this embodiment is formed by, for example, overlaying bonding sections 22A, 22A and 22B, 22B at both ends of two plates which are formed into a predetermined size and shape by rolling or pressing.

And, in this tube member 2' of this embodiment, the outer periphery of the end of the tube member 2' is held by the forming jig in the same way as in the previous embodiment, the projections 41 of the forming jig 40 are inserted into the passages 24 of the tube member 2' to adhere tightly the faces of the beads 21, 21 on the outer faces of the tube member 2', so that the upper and lower faces in the vicinity can be made substantially flat with the double-walled beads 21 remained inside and in the neighborhood of the tube member 2'.

Therefore, in the tube which was formed of two members in this embodiment, the brazing property of the header pipe 4 and the tube member 2' can be improved while retaining a sufficient pressure resistance of the tube end.

Figure 9:
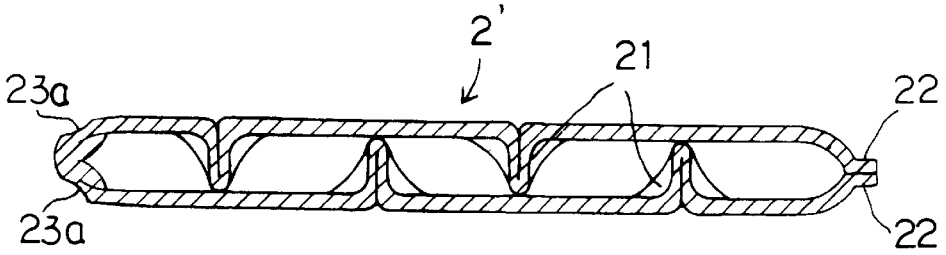
FIG. 9 is a sectional view of the tube member end according to another embodiment of the invention.
Figure 10:
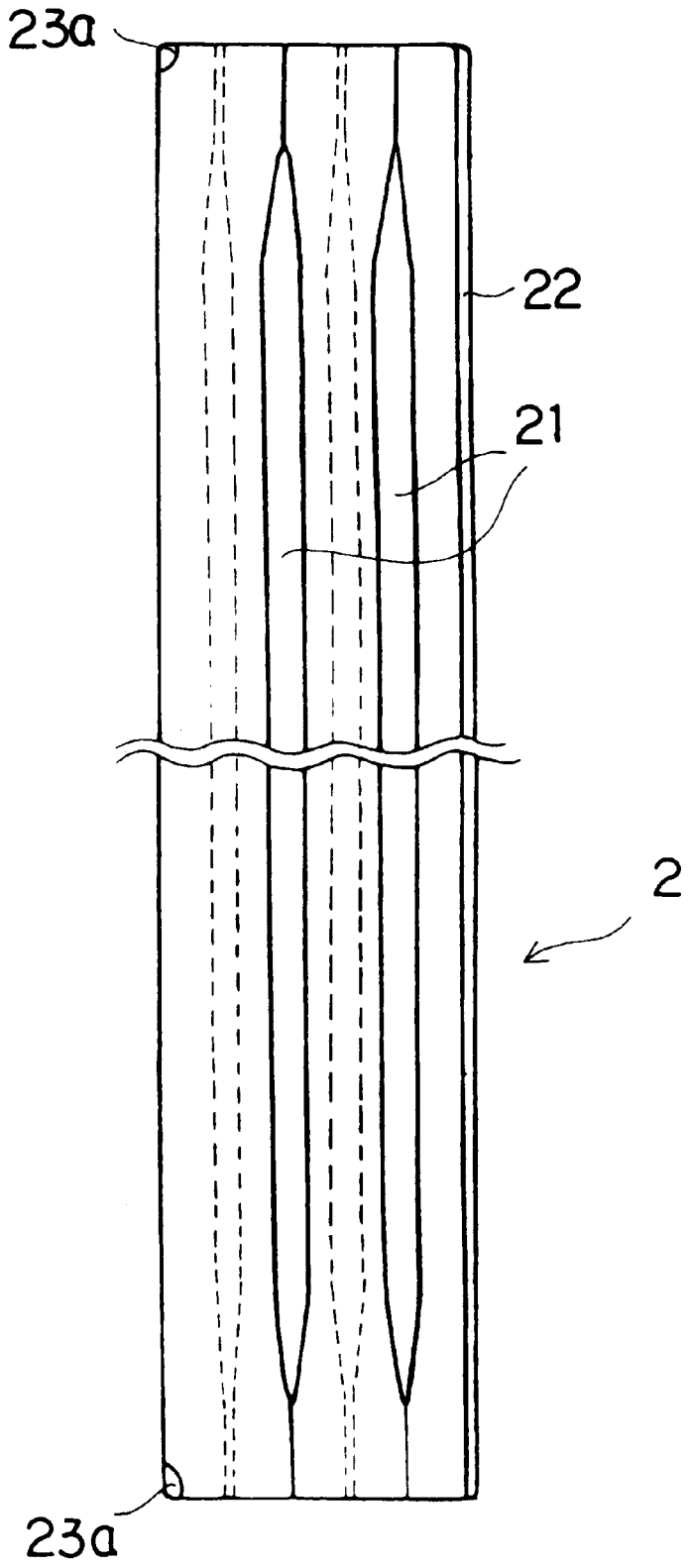
FIG. 10 is a plan view of the tube member shown in FIG. 9.

FIG. 9 and FIG. 10 show another embodiment of the tube; FIG. 9 is a front view showing the end of the tube, and FIG. 10 is a plan view of the tube.

As shown in FIG. 9, the tube member 2' is formed by rolling a plate having the beads 21 as described above. And, the end of the tube member 2' is made to have substantially a flat face by having the faces of the beads 21, 21 on the outer face of the tube member 2' mutually adhered tightly by the forming jig 40. And, crushed portions 23*a*, 23*a* are formed by pressing from above and below only the end edge of the bending part 23 of the tube member 2'.

As described above, with the crushed portions 23*a*, 23*a* which are formed at both ends in the vertical direction of the bending part 23 of the tube member 2', there is a margin for the crushed portion 23*a* when the tube member 2' is inserted into the tube hole 7, so that the tube member 2' is easily inserted into the tube hole 7, and the assembling property is also improved. Besides, the crushed portion 23*a* is at the edges of the tube member 2' and only on the side of the bending part 23. Therefore, when the tube member 2' has been assembled to the tube hole 7, the crushed portion 23*a* is located in the header pipe 4, and the substantially flat face of the tube member 2' is in contact with the tube hole 7 of the header pipe 4. Thus, the good brazing property can be secured in the same way as in the previous embodiment without producing a gap between the tube hole 7 and the tube 2.

Figure 11:
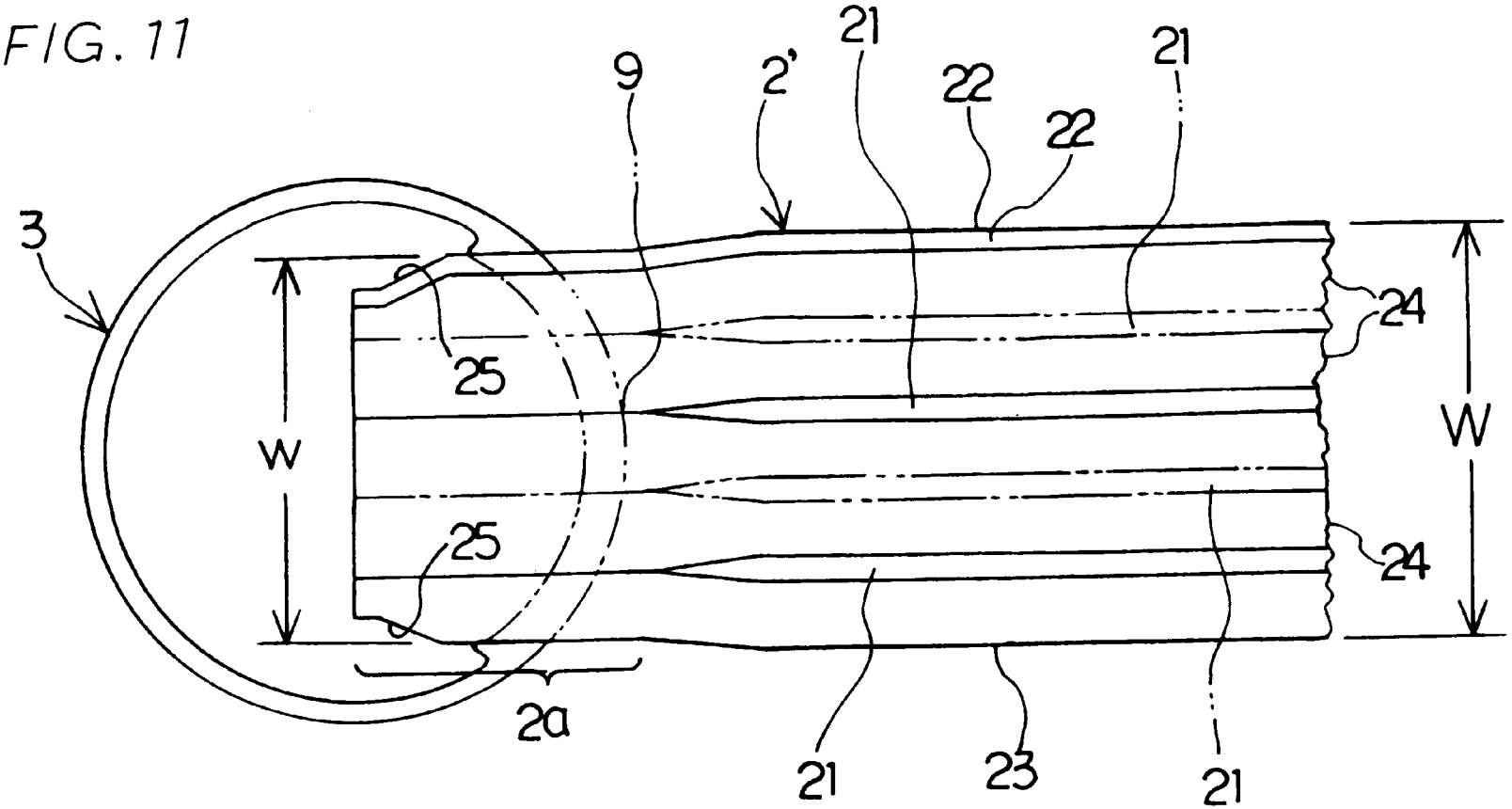
FIG. 11 is a plan view showing a state that the end of the tube member is inserted into the tube hole of the header pipe according to an embodiment of the invention.
Figure 12:
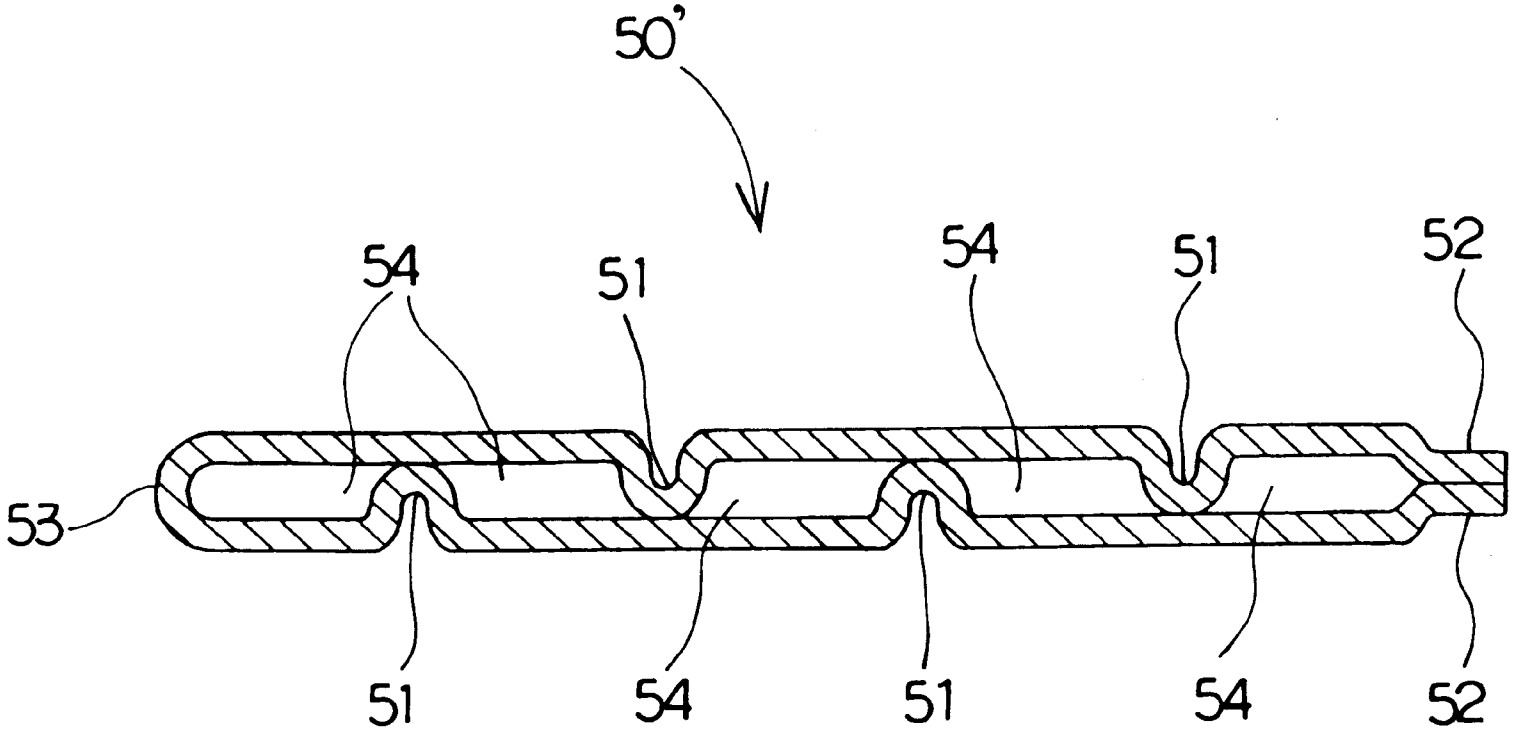
FIG. 12 is a end view showing the tube member according to a conventional embodiment.
Figure 13:
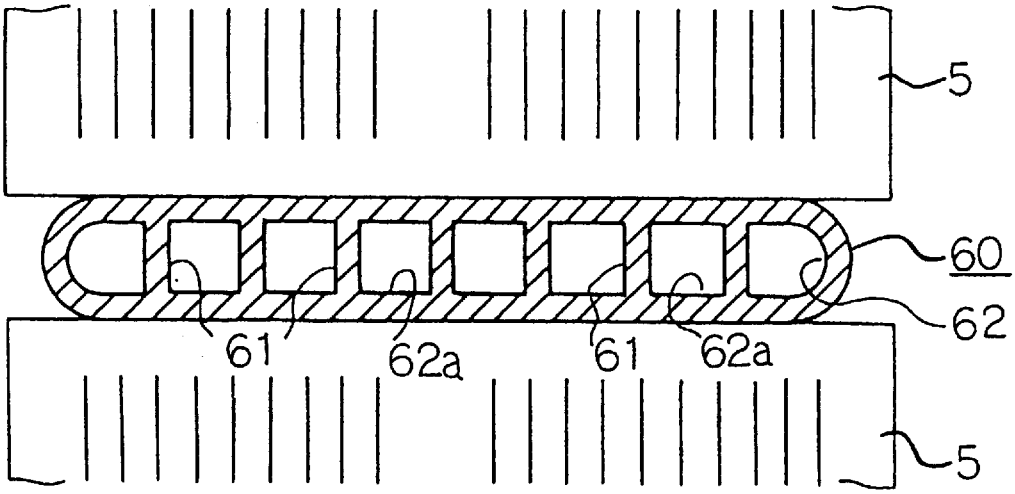

The tube member 2' shown in FIG. 11 has tapers 25, 25 formed from outer to inner sides along the axial direction toward the leading end of the end 2*a*.

Specifically, a width w of the end 2*a* of the tube member 2' is formed slightly smaller than a width W of other portion of the tube member 2' by folding the plate and compressing in the breadth direction. And, the end 2*a* of the tube member 2' has a cross-sectional shape corresponding to the tube hole 9, and its length in the state inserted into the tube hole 9 is determined within 10 mm outside the header pipe 3 or the header pipe 4 on which the tube hole 9 is formed. The compression of the end 2*a* is a so-called sizing, which can provide a predetermined size accurately. Deviation of the bonding section 22, 22 is compensated by this compression.

The tapers 25, 25 at the leading end of the end 2*a* of the tube member 2' are formed by inserting the leading end of the end 2*a* into a die for forming the tapers (not shown) after completing the process steps described above.

In the heat exchanger of this embodiment, the recess of the bead within 10 mm outside from the header pipe has a cross-sectional area of about 0.2 $mm^2$ or below, so that the end of the tube member can have a maximum clearance of 10 mm for the insertion degree of the tube into the tube hole. As a result, brazing reliability of the end of the tube member and the tube hole of the header pipe can be improved.

And, the heat exchanger of this embodiment can be made to have a predetermined size accurately because the end of the tube member is formed by compressing, and it is possible to prevent a situation that the end of the tube member cannot be inserted into the tube hole of the header pipe.

As described above, the heat exchanger of this embodiment has the tapers formed from the outer to inner sides along the axial direction toward the leading end of the end of the tube member, so that the end of the tube member can be inserted into the tube hole of the header pipe with ease, and an efficiency of assembling of the tube member and the header pipe can be improved.

In this embodiment, four beads 21, 21 were formed along the longitudinal direction of the tube member 2' to form five medium passages 24, 24 in the same tube member 2'. But, the number of beads can be determined to a desired number. And, the beads in this embodiment were alternately formed on the upper and lower faces of the tube, but they may be formed on one of the faces, or the tops of the beads protruded from the upper and lower faces can be contacted one another in the middle of the tube member 2. Besides, the tube member of this embodiment was formed by bending a single plate along its center bending part in the breadth direction, but the tube member can also be formed by overlaying the bonding sections at the ends of two plates. Furthermore, the long beads were continuously formed in the longitudinal direction of the tube member in this embodiment, but various shapes of beads may be formed intermittently, or a gap may be formed at a predetermined part of the long beads so to communicate with the adjacent passages.

As described above, the invention relates to a heat exchanger comprising a plurality of tube members formed by bending a single plate or stacking two plates, and the ends of the tube members inserted into tube holes of header pipes to communicate the tubes with the header pipes, characterized in that the tube members are provided with beads formed to protrude from the face of one plate toward the other plate, the tube members have the bead faces bonded mutually on the outer faces of the tube members at their ends which are inserted into the tube holes of the header pipes so that the upper and lower faces of the ends of tube members are substantially flat.

Thus, since the upper and lower faces at the end of the tube member are formed substantially flat, the substantially flat face of the tube comes in contact with the end of the tube insertion hole, the tube can be assembled to the header pipe without forming a large gap between the tube insertion hole and the tube, and the brazing property can be improved. Therefore, a ratio of non-quality products in the production is reduced, and the product reliability can be improved.

And, the tube's strength in the header pipe can be secured by the beads with the inner faces mutually contacted as described above.

The invention relates to the heat exchanger, wherein a recess formed by mutually bonding the bead faces on the outer face of the tube member have a cross-sectional area of about 0.2 $mm^2$ or below.

When the recesses of the beads at the end of the tube member have a cross-sectional area of about 0.2 $mm^2$ or below, the end of the tube member and the tube hole of the header pipe can be brazed well, and a ratio of quality products can be improved.

The recesses of the beads at the end of the tube member have formed a gap between the tube hole of the header pipe, causing a failure in brazing. But, the present invention can fill the gap with a brazing material flowing while brazing because such a recess has a cross-sectional area of about 0.2 $mm^2$ or below and can improve the brazing property.

The invention relates to the heat exchanger, wherein a region, where the recess has a cross-sectional area of about 0.2 $mm^2$ or below, is disposed within 10 mm outside the header pipe.

When a region, that the cross-sectional area of the recess of the bead is about 0.2 $mm^2$ or below, is formed within 10 mm outside the header pipe, an inserted degree of the tube into the tube hole can have a maximum clearance of 10 mm, and as a result, the brazing reliability between the end of the tube member and the tube hole of the header pipe can be improved.

Even if the inserted degree of the end of the tube member is different from the one initially determined due to deviation of the sizes of the tube member, the end of the tube member and the tube hole of the header pipe can be brazed well.

The invention relates to the heat exchanger, wherein the bead at the end of the tube member has a wall thickness smaller than that of the plate.

At the end of the tube member, the beads have a wall thickness smaller than that of the plate, and, therefore, the end of the tube member can be fabricated readily.

The invention recited in claim 5 relates to the heat exchanger as set forth in any one of claims 1 through 4, wherein the end of the tube member is formed by compressing in the breadth direction and has a cross-sectional shape corresponding to the tube hole.

Since the end of the tube member is formed by compressing, a predetermined size can be obtained accurately, so that a situation that the end of the tube member cannot be inserted into the tube hole of the header pipe can be prevented.

And, the end of the tube member has a cross-sectional shape corresponding to the tube hole, so that the insertion of the tube member into the tube hole can be secured properly.

The invention relates to the heat exchanger, wherein a tapered portion is formed from the outer to inner sides along an axial direction of the tube member toward the leading end of the end of the tube member.

Thus, since the heat exchanger of this claim forms the taper from outer to inner sides along the axial direction of the tube member toward the leading end of the end of the tube member, the end of the tube member can be inserted into the tube hole of the header pipe with ease, and the efficiency of assembling the tube member and the header pipe can be improved.

The invention recited in claim 7 relates to a method of producing a heat exchanger comprising a plurality of tube members formed by bending a single plate or stacking two plates, and the ends of the tube members inserted into tube holes of header pipes to communicate the tubes with the header pipes, comprising the steps of: forming a plurality of beads to protrude from the face of one plate toward the other plate so that a plurality of passages, through which a heat exchange medium flows, are formed inside the tube members by the beads, inserting a jig between the passages from the end of the tube member to hold side walls of the beads at the end edge of the tube member and press them together, thereby the bead faces at the outer face of the tube member are brought in pressure contact, and forming the upper and lower faces of the end of the tube member substantially flat, and inserting the tube members, which have the inner faces of the beads in pressure contact with each other to make the upper and lower faces of the ends of the tube members substantially flat, into the header pipes to assemble them together, and brazing them integrally.

Thus, the jig is inserted into the passages of the tube member from the end of the tube member to press the bead side walls, so that only the upper and lower faces of the tube end can be formed substantially flat. Using the tube having the beads formed uniformly and quickly, a heat exchanger having good brazing property can be produced. According to the method of the present invention, it is not necessary to form a double-wall projection along the longitudinal direction of the tube to make the upper and lower faces of the tube substantially flat like the prior art, and the production can be simplified. And, since the tops of the beads are contacted to the flat face of the opposed plate, the contact areas are increased to provide good brazing property, and the pressure resistance of the tube is improved.

What is claimed is:

1. A method of producing a heat exchanger comprising a plurality of tube members formed by bending a single plate or stacking two plates, and the ends of the tube members inserted into tube holes of header pipes to communicate the tubes with the header pipes, comprising the steps of:

forming a plurality of U-shaped beads extending from one end of the plate to the other end of the plate and protruding from the face of one plate toward the other plate so that a plurality of passages, through which a heat exchange medium flows, are formed inside the tube members by the beads, inserting a jig into the passages from an end of a tube member to hold and outwardly press two side walls of the U-shaped beads at the end of the tube member so that outer faces of the U-shaped beads provided on the tube member are brought into pressure contact with each other and the U-shaped beads at the end of the tube member are changed to I-shaped projections of double-walls, while the U-shaped beads between both ends of the tube member remain as they are, thereby making the upper and lower faces of the end of the tube member substantially flat, and inserting the ends of the tube members, which have the outer faces of the beads in pressure contact with each other to make the upper and lower faces of the ends of the tube members substantially flat, into the header pipes to assemble them together, and brazing them integrally.

2. The method of producing a heat exchanger according to claim 1, which further comprises the step of bringing the tops of the both U-shaped beads protruded from both plates into pressure contact with each other.

3. The method of producing a heat exchanger according to claim 1, wherein a recess provided on the substantially flat faces after bringing the outer faces of the U-shaped beads provided on the tube member in pressure contact with each other has a cross-sectional area of less than about 0.2 $mm^2$.

4. The method of producing a heat exchanger according to claim 3, wherein a region at the end of the tube member where the recess has the cross-sectional area of less than 0.2 $mm^2$, is provided within 10 mm outside the header pipe.

5. The method of producing a heat exchanger according to claim 2, wherein a recess provided in the substantially flat faces by bringing the outer faces of the U-shaped beads provided on the tube member in pressure contact with each other has a cross-sectional area of less than about 0.2 $mm^2$.

6. The method of producing a heat exchanger according to claim 5, wherein a region at the end of the tube member where the recess has the cross-sectional area of less than 0.2 $mm^2$, is provided within 10 mm outside the header pipe.

* * * * *